US008863819B2

(12) United States Patent
Benedetti et al.

(10) Patent No.: US 8,863,819 B2
(45) Date of Patent: Oct. 21, 2014

(54) CONTINUOUS CASTING DEVICE AND RELATIVE METHOD

(75) Inventors: Gianpietro Benedetti, Tricesimo (IT); Andrea Carboni, Milan (IT); Paolo Bobig, San Canzian d'Isonzo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 13/698,388

(22) PCT Filed: May 17, 2011

(86) PCT No.: PCT/EP2011/057926

§ 371 (c)(1), (2), (4) Date: Jan. 28, 2013

(87) PCT Pub. No.: WO2011/144590

PCT Pub. Date: Nov. 24, 2011

(65) Prior Publication Data

US 2013/0139993 A1 Jun. 6, 2013

(30) Foreign Application Priority Data

May 18, 2010 (IT) ..... UD2010A0095

(51) Int. Cl.

| | |
|---|---|
| ***B22D 11/12*** | (2006.01) |
| ***B22D 11/00*** | (2006.01) |
| ***B22D 11/128*** | (2006.01) |
| ***B65H 23/00*** | (2006.01) |

(52) U.S. Cl.

CPC ..... *B22D 11/00* (2013.01); *B22D 11/1282* (2013.01); *B65H 23/00* (2013.01); *B22D 11/1285* (2013.01); *B22D 11/1206* (2013.01); *B22D 11/1213* (2013.01)

USPC ..... 164/442; 164/443; 164/476; 164/477

(58) Field of Classification Search

CPC ..... B22D 11/1282; B22D 11/1213; B22D 11/00; B22D 11/1206; B22D 11/1285; B21B 1/46–1/466

USPC ..... 164/442, 443, 476, 477; 72/200, 202

See application file for complete search history.

(56) References Cited

U.S. PATENT DOCUMENTS 4,420,029 A 12/1983 Kameyama et al.
4,452,587 A * 6/1984 Laws et al. ..... 432/245

(Continued)

FOREIGN PATENT DOCUMENTS

DE 10236368 A1 9/2003
DE 102010022003 A1 * 12/2010

(Continued)

OTHER PUBLICATIONS

International Search Report, Aug. 17, 2011, from international application No. PCT/EP2011/057926.

(Continued)

*Primary Examiner* — Keith Walker
*Assistant Examiner* — Kevin E Yoon
(74) *Attorney, Agent, or Firm* — Novak Druce Connolly Bove + Quigg LLP

(57) ABSTRACT

A continuous casting device including at least a crystallizer suitable for casting a metal product, and a plurality of guide and containing segments with rolls, the function of which is to accompany the cast product exiting from the crystallizer. The device includes, an extension of or in an intermediate position to one or more of the guide and containing segments with rolls, one or more guide and containing segments of the mixed type with panels and rolls, each including one or more guide rolls disposed on at least one side of the product and insulated and/or reflecting and/or heated panels disposed on the opposite side of the product, so as to reduce the loss of temperature of the cast product in transit.

6 Claims, 3 Drawing Sheets

(56) References Cited

U.S. PATENT DOCUMENTS

| | | | | |
|---|---|---|---|---|
| 5,630,467 | A | 5/1997 | Yoshimura et al. | |
| 5,711,175 | A * | 1/1998 | Laws et al. | 72/202 |
| 6,892,794 | B2 | 5/2005 | Zajber et al. | |
| 2004/0020632 | A1 * | 2/2004 | Zajber et al. | 164/484 |

FOREIGN PATENT DOCUMENTS

| | | | |
|---|---|---|---|
| GB | 1473357 | A | 5/1977 |
| JP | 55139155 | A | 10/1980 |
| JP | 57199553 | A | 12/1982 |
| JP | 58148059 | A | 9/1983 |
| JP | 58157560 | A | 9/1983 |
| JP | 60257957 | A * | 12/1985 |
| JP | 63207461 | A * | 8/1988 |
| JP | H11170019 | A | 6/1999 |
| KR | 20040079409 | A | 9/2004 |
| WO | 03070399 | A1 | 8/2003 |

OTHER PUBLICATIONS

Written Opinion, Aug. 17, 2011, from international application No. PCT/EP2011/057926.

Jul. 3, 2014, Official Action issued in corresponding Korean Patent Application No. 10-2012-7033146.

* cited by examiner

CONTINUOUS CASTING DEVICE AND RELATIVE METHOD

CROSS-REFERENCE TO RELATED APPLICATIONS

This application is a §371 National Stage Application of International Application No. PCT/EP2011/057926, filed on 17 May 2011, claiming the priority of Italian Patent Application No. UD2010A000095 filed on 18 May 2010, each incorporated herein by reference.

FIELD OF THE INVENTION

The present invention concerns a continuous casting device and the relative method.

In particular, the present invention concerns the continuous casting of steels of different types, for example commercial steels, steels with a high carbon content, medium alloy steels or other, in which specific containing and guide devices are used, and can possibly be replaced, disposed at exit from the crystallizer/ingot mold in relation to the casting speed, which can vary according to the type of steel as above.

The invention also concerns containing and guide devices for a cast product comprising elements to reduce the heat losses associated with roll elements to guide and transport the cast product located at exit from the ingot mold.

BACKGROUND OF THE INVENTION

A continuous casting device normally provides an ingot mold comprising a crystallizer inside which the liquid metal is cast, and a series of containing and guide elements, such as rolls or other similar means, which accompany the at least partly solidified cast product, and during the step of progressive solidification, between the exit from the ingot mold and the first elements that make up the rolling line, for example shears, a heating furnace, a first roughing cage or a rolling train.

Normally, the segment at exit from the ingot mold is curved, so as to connect the vertical or sub-vertical direction along which the casting is carried out and the horizontal direction in which rolling is performed.

By cast product, here and hereafter in the description, we mean a slab, a bloom a billet of various sizes and section.

Examples of such containing and guide elements can be seen for example in U.S. Pat. No. 5,630,467, where there are segments of rolls that have a progressively increasing section as they are distanced from the exit of the ingot mold, and mobile toward and away from the cast product, and curved continuous segments that accompany the completely solidified product and dispose it on the horizontal plane so as to send it to the rolling passes.

The presence of mobile roll elements at exit from the crystallizer is necessary so as to perform the soft reduction procedure, or reduction in thickness with liquid core, where the cast product is reduced in thickness, exploiting the fact that its inner core is not yet completely solidified.

Document U.S. Pat. No. 6,892,794 B2 shows a casting device in which, at exit from the ingot mold, there are consecutive segments of rolls that accompany the cast product in the step of progressive solidification, and in which the elements that support the cast product modify their conformation as the progressive increase in thickness of the solidified part of the product varies.

Normally, these containing and guide elements cooperate with so-called secondary cooling systems, to distinguish it from the primary cooling that takes place inside the ingot mold. Such secondary cooling systems contribute to define the solidification profile of the cast product, allowing to regulate the position of the so-called "kissing point", that is, the point where the two solidified semi-skins of the cast product meet, for example as a function of the type of material and the final result to be obtained.

In the field of continuous casting it is also known, however, that as the type of steel to be produced varies, it is necessary to consequently adjust the casting parameters, in particular the speed of extraction of the product.

It is for example known that certain steels, for example so-called commercial steels, are cast at relatively high speeds, up to 6-7 m/min, while for other steels, for example high carbon content steels, medium alloy steels and others, the speed must be reduced to values in the range of about 3-4 m/min.

When the casting speed passes from the higher value to the lower value, the metallurgical length is proportionally reduced, even by 6-10 meters, and therefore, after the so-called kissing point where the metallurgical cone is closed, the cast product has to travel a longer segment and also at a lower speed, with a relative greater temperature loss compared with higher casting speeds.

This temperature loss entails a high waste of energy and also limits rolling fitness in terms of compression percentage downstream of the continuous casting.

DE 102 36 368 shows containing segments with rolls that can be equipped with heat insulation panels, for example vertical, disposed around the transit path of the cast product.

The purpose of the present invention is therefore to solve this shortcoming, proposing a solution that allows to adjust the heat conditions of the cast product at exit from the ingot mold to the variations in the casting speeds deriving, for example but not only, from modifications in the type of steel that is being cast.

Another purpose of the invention is to obtain this adjustment with a relatively simple and efficient solution which does not entail any extension of the casting line and that does not require the use of additional elements that modify the trajectory and/or bulk of the casting machine.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the invention provides that, in a continuous casting machine comprising a casting unit of the substantially traditional type, with an ingot mold/crystallizer, and a containing, guide and possibly cooling unit, located at exit from the casting unit, at least part of the containing, guide and possible cooling elements are replaceable in relation to the variation in casting speed that may depend, for example but not only, on the type of steel that is being cast.

More particularly, the invention provides a first type of containing, guide and possible cooling unit, which comprises containing and guide rolls for the cast product associated with a substantial part of the at least partly curved path that connects the exit of the casting unit to the horizontal segment that then leads to rolling, and at least a second type of containing and guide unit which comprises, instead of part of the rolls, one or more insulating and/or thermally heated panels, for example but not only insulated and/or with a reflecting surface and/or heated for example by electric resistances.

According to the invention, the insulating and/or thermally heated panels are used in the case of relatively low casting speeds, for example in the range of 4-5 meters/minute, to replace part of the normal containing and guide rolls that are used for higher casting speeds, in order to reduce as much as possible the temperature losses due to the longer time that the completely solidified product takes to exit from the continuous casting machine.

According to the invention, thanks to using these insulated and/or reflecting panels, it is possible to reduce the overall temperature loss by 50% and even more than 90% if the panels are heated, for example electrically; in this way the reduction in speed deriving from the different type of steel cast is compensated.

Furthermore, given the reduced number of containing and guide rolls in contact with the cast product, losses by conduction deriving from said contact are also reduced.

According to the invention, moreover, the length of the casting machine remains unchanged using the first or the second type of containing, guide and possible cooling unit, inasmuch as no auxiliary elements are inserted in addition to those already present on the line, and only segments of the roll only type are replaced by segments partly made up of panels, and vice versa.

The replacement of the segments may be performed manually or automatically by means of suitable robots or similar or comparable systems, during the downtimes of the line required for modifying the type of product to be cast and/or for configuring the line.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
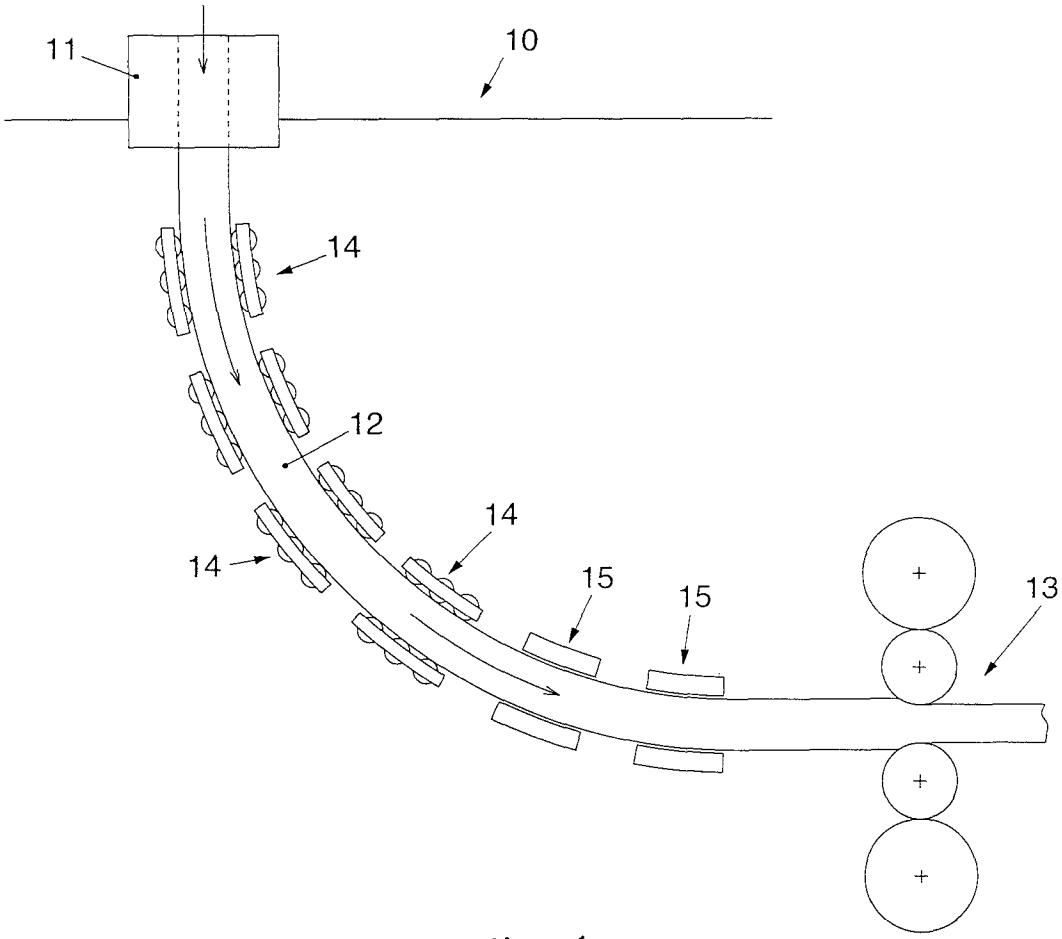
FIG. 1 is a schematic view of a segment of a casting line in which the present invention is applied.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DESCRIPTION OF A PREFERENTIAL FORM OF EMBODIMENT

With reference to FIG. 1, a curved continuous casting line 10 is shown schematically, comprising a crystallizer 11 suitable for casting slabs, blooms or billets, identified generically by the reference number 12 to denote the cast product.

The curved casting line connects the crystallizer 11 disposed vertically with the rolling line disposed horizontally, of which a first roughing stand 13 is shown, to give a non-restrictive example.

The system for conveying the cast product 12 comprises a plurality of roll-type guide and containing segments, indicated generically by the reference number 14, the function of which is to accompany the cast product 12 along the curved line, determining in a substantially known manner its progressive cooling and solidification, so as to determine the closure of the metallurgical cone, based on the type of steel and consequently on the casting speed.

As the casting speed varies, for example passing from a speed of about 7 meters a minute to a speed of about 4 meters a minute, the cast product 12 must travel, after the point of closure of the metallurgical cone, a longer segment at low speed with relative temperature loss.

Figure 2:
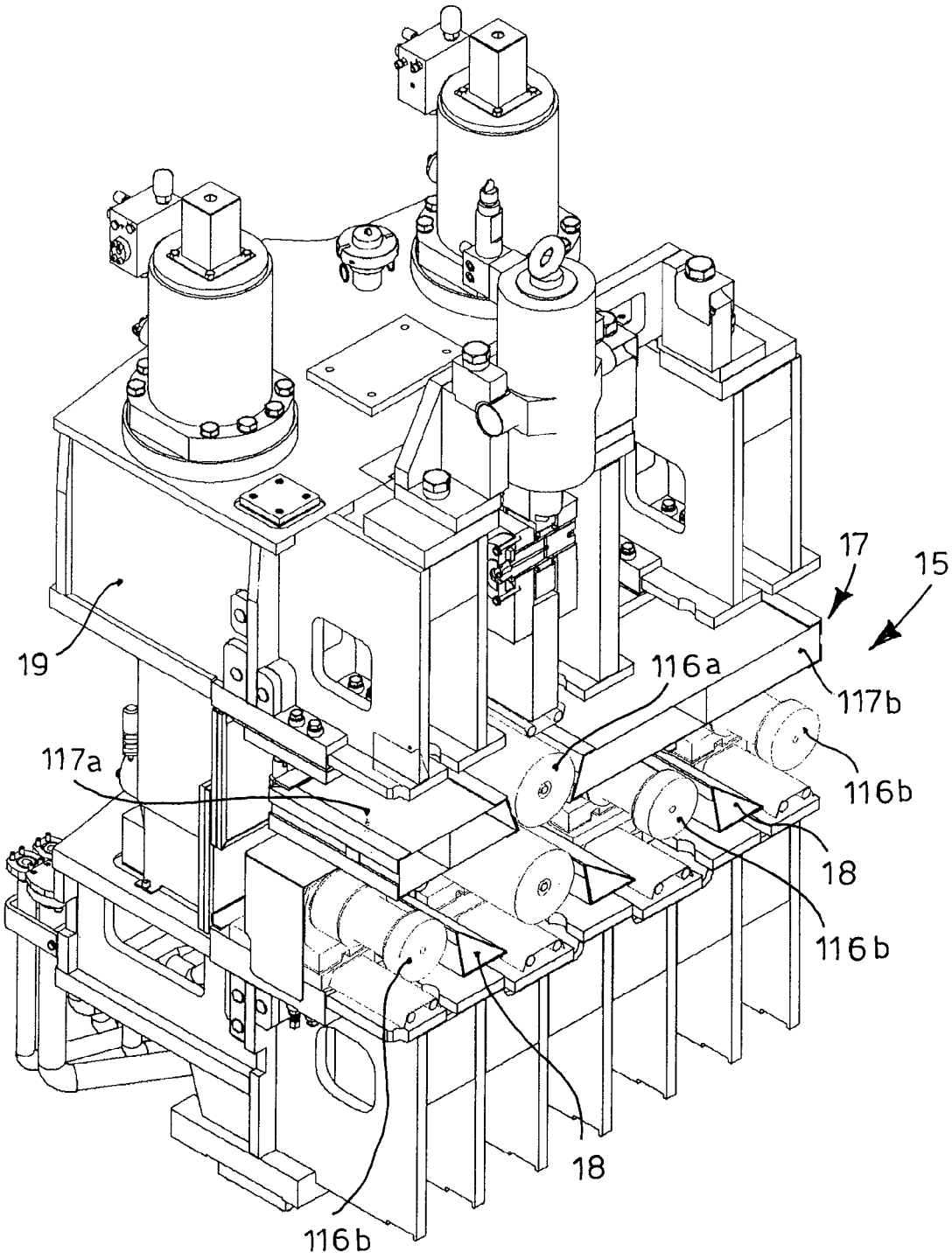
FIG. 2 is a perspective view of a guide and containing segment used in the present invention.
Figure 3:
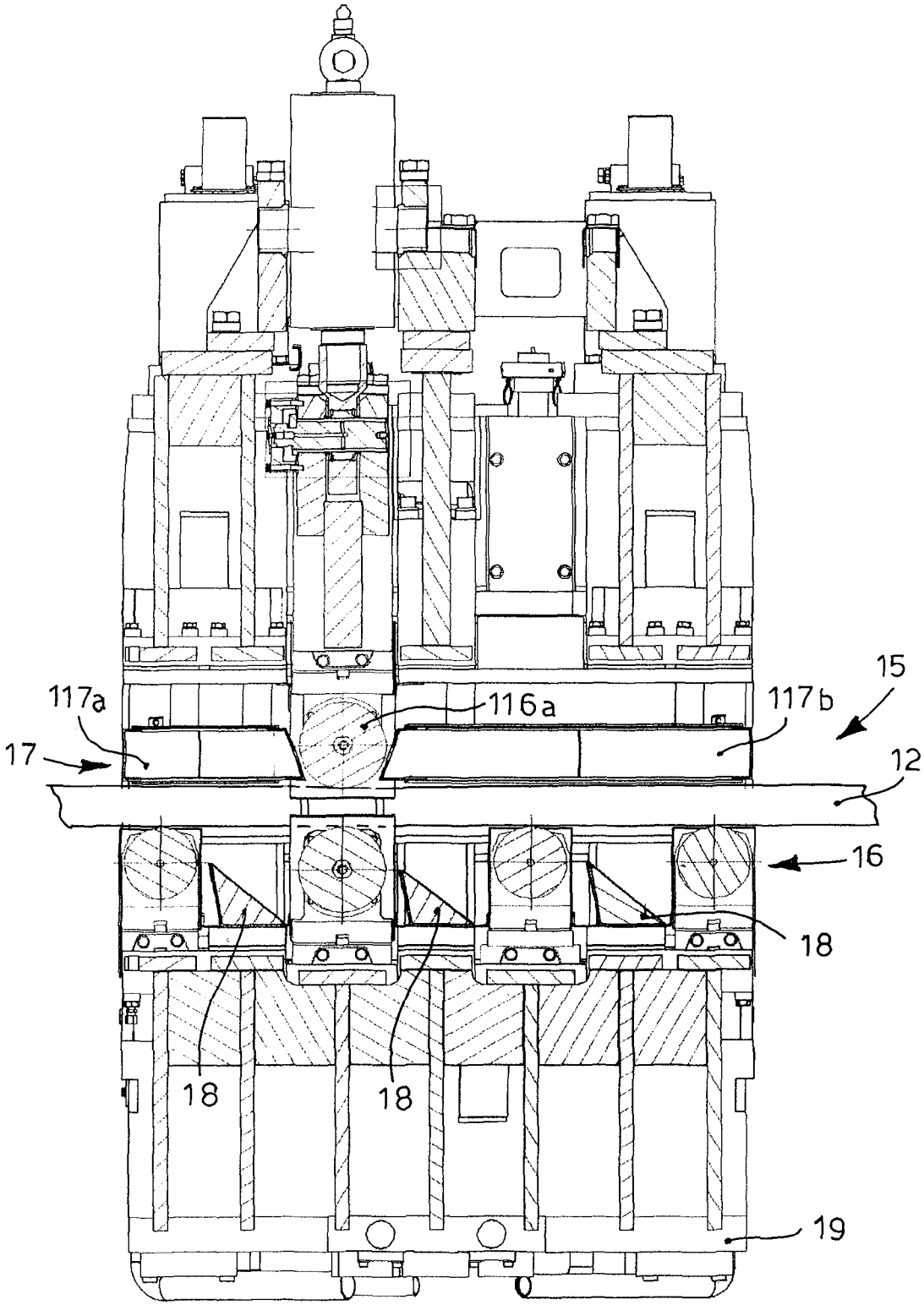
FIG. 3 is a lateral section of the guide and containing segment in FIG. 2.

In this case the invention provides that one or more of the guide and containing segments 14 can be replaced by guide and containing segments 15 of a mixed type with panels and rolls, an example of which is shown in FIGS. 2 and 3.

The guide and containing segments 15 comprise guide rolls 16 disposed on at least one side (extrados side) to guide and accompany the cast product 12 as it advances, while on the opposite side there are insulated and/or reflecting and/or heated panels 17, the function of which is to reduce the temperature loss of the cast product 12 transiting at low speed.

More specifically, in the solution shown, the upper side (or intrados) of the guide and containing segment 15 comprises a first panel 117*a* at entrance, an intermediate roll 116*a* and a second panel 117*b* at exit from the segment.

The side of the panels 117, 117*b* facing toward the intermediate panel 116*a* is inclined in order to leave uncovered as little space as possible of the surface of the cast product 12 in transit during its passage through the guide and containing segment 15.

The presence of a single intermediate roll 116*a*, which is however advantageous to guarantee the correct guide of the cast product 12, for the whole upper side (intrados) of the containing and guide segment 15, reduces to a minimum the temperature losses due to the contact between the surface of the product 12 and the surface of the roll 116*a*.

On the lower side (or extrados) of the containing and guide segment 15, where the weight of the cast product 12 in transit rests, there are a plurality of rolls 116*b*, four in this case, which guide and contain the cast product 12 during its advance.

The rolls 116*b* have a lesser diameter than traditional rolls, and in an intermediate position between them there are insulated and/or reflecting plates 18, which also have the function of reducing to a minimum the temperature losses of the cast product 12 during its transit at low speed through the containing and guide segment 15.

The plates 18 are triangular in shape with the long side facing toward the lower surface of the cast product 12 in transit.

The triangular shape, inclined downward, facilitates the discharge of the scale that detaches from the cast product; the non-accumulation of scale on the plates 18 allows to keep their insulating function practically unchanged over time.

It is clear that, although the solution shown represents a mixed configuration of rolls/panels that is extremely valid from the point of view of heat containment, other mixed solutions of panels/rolls may equally be adopted and may have an effectiveness comparable to the one shown, which therefore serves only as a non-restrictive example.

The segments 14 of a known type, consisting completely of rolls, and the segments 15 of the mixed type with panels and rolls have an external bulk, defined by the relative support frame 19, substantially identical to each other, so that they are totally replaceable with respect to each other without determining extensions or shortenings of the casting line, since no auxiliary or additional elements are required.

If the configuration of the continuous casting machine is changed, for example to pass from one type of steel that can be cast at a speed for example of 6-7 m/min or more to a type of steel that requires a lower casting speed, for example 4-5 m/min or less, one or more of the containing segments 14 can be replaced by one or more containing segments 15 of the mixed panels/rolls type, with manual or automatic systems, to adapt the curved casting line to the various requirements of heat protection.

Such replacement may be performed by manipulator robots or, if it is not possible to use robots, by means of bridge cranes, and may last for the time required for the change in configuration, so that it can be carried out without causing any slowdowns in production.

The panels 117*a*, 117*b* may be made of metal covered by reflecting paints, or other suitable material of a known type.

According to a variant, the panels 117*a*, 117*b* incorporate or are covered by mirror elements, for example sheets of steel, to increase the reflecting effect.

The invention claimed is:

1. A continuous casting device, comprising:

a crystallizer for casting a metal product, said metal product having opposed first and second sides, and a plurality of guide and containing segments with rolls for accompanying the cast product exiting from the crystallizer, in extension of or in an intermediate position to one or more of said guide and containing segments with rolls, at least one guide and containing segment of a mixed type with panels and rolls comprising one or more guide rolls for being disposed on a first side of the product and at least one panel selected from the group consisting of insulated, reflecting and heated panels for being disposed on the second side of the product while the one or more guide rolls are being disposed on the first side of the product, to reduce the loss of temperature of the cast product in transit, said guide and containing segment of mixed type defining a path, having opposed first and second sides, for passing the metal product therethrough, the first side of the path for the first side of the product to travel therethrough, the second side of the path for the second side of the product to travel therethrough, a number of said guide rolls on the first side of the path directly opposed to the panels on the second side of the path.

2. A continuous casting device as in claim 1, wherein said at least one mixed guide and containing segment with rolls and panels comprises, at least one panel selected from the group consisting of a first insulated, reflecting and heated panel at entry for being disposed on the second side of the product and at least a second panel at exit from the segment for being disposed on the second side of the product, and further comprising at least an intermediate roll for being disposed on the second side of the product and being between the first panel and the second panel.

3. A continuous casting device as in claim 2, wherein the side of the panels facing toward the intermediate roll is inclined to reduce to a minimum the uncovered space of the surface of the cast product in transit during its passage through the containing and guide segment.

4. A continuous casting device as in claim 1, wherein on the first side of the path opposite that where the at least one panel selected from the group consisting of insulated, reflecting and heated panels is located, at least one of the rolls is of reduced size as compared to a roll of the guide and containing segments with rolls, and further comprising insulated and/or reflecting plates are positioned between two adjacent said rolls for being disposed on the first side of the product.

5. A continuous casting device as in claim 4, wherein the first side of the product is a lower side in transit, wherein the plates are of a triangular shape having at least one long side and at least one short side with the long side directly facing toward the lower surface of the cast product in transit.

6. A continuous casting device as in claim 1, the containing and guide segments with rolls have an external bulk, defined by a relative support frame, substantially equal to the segments of the mixed type including panels and rolls, to be able to be replaced and interchanged one with the other without determining extensions or shortenings of the continuous casting machine.

* * * * *

UNITED STATES PATENT AND TRADEMARK OFFICE

CERTIFICATE OF CORRECTION

PATENT NO. : 8,863,819 B2
APPLICATION NO. : 13/698388
DATED : October 21, 2014
INVENTOR(S) : Gianpietro Benedetti, Andrea Carboni and Paolo Bobig It is certified that error appears in the above-identified patent and that said Letters Patent is hereby corrected as shown below:

In the Claims

Claim 4, starting at column 6, line 26 amend as follows:
"further comprising insulated and/or reflecting plates"

Signed and Sealed this
Twenty-seventh Day of January, 2015

Michelle K. Lee

Michelle K. Lee
*Deputy Director of the United States Patent and Trademark Office*